US005403127A

United States Patent [19]

Knudsen

[11] Patent Number: 5,403,127

[45] Date of Patent: Apr. 4, 1995

[54] RETAINING WALL STRUCTURE

[76] Inventor: Poul N. Knudsen, 5, St. th, Dagmarsgade, DK-2200 Copenhagen N., Denmark

[21] Appl. No.: 81,318

[22] PCT Filed: Dec. 18, 1991

[86] PCT No.: PCT/DK91/00397

§ 371 Date: Jun. 25, 1993

§ 102(e) Date: Jun. 25, 1993

[87] PCT Pub. No.: WO92/12296

PCT Pub. Date: Jul. 23, 1992

[30] Foreign Application Priority Data

Dec. 28, 1990 [GB] United Kingdom ..... 9028130

[51] Int. Cl.[6] ..... E02D 29/02

[52] U.S. Cl. ..... 405/286; 405/284

[58] Field of Search ..... 405/258, 262, 272, 273, 405/284, 285, 286

[56] References Cited

U.S. PATENT DOCUMENTS

| | | | |
|---|---|---|---|
| 2,123,016 | 7/1938 | McDaniel | 61/47 |
| 2,892,340 | 6/1959 | Fort | 405/286 X |
| 4,341,491 | 7/1982 | Neumann | 405/258 |
| 4,449,858 | 5/1984 | Hynds | 405/286 |
| 4,490,075 | 12/1984 | Risi et al. | 405/273 |
| 4,923,339 | 5/1990 | Smith | 405/284 |
| 4,932,812 | 6/1990 | Schaaf | 405/284 |

FOREIGN PATENT DOCUMENTS 0034565 8/1981 European Pat. Off. .

OTHER PUBLICATIONS

International Search Report for International Application PCT/DK91/00397, dated Mar. 27, 1992.

*Primary Examiner*—David H. Corbin

*Attorney, Agent, or Firm*—Fitch, Even, Tabin & Flannery

[57] ABSTRACT

A retaining wall structure (1) for large-scale construction works, such as roads, railway tracks or quay constructions, where substantial amounts of earth or material are to be retained, and where said wall structure is constituted by panels. The wall structure comprises a front wall (2) and a rear wall (3) locked at a distance from said front wall by means of easily mountable crossbeams (4, 4'). The crossbeams are locked relative to one another in vertical direction by means of locking beams (5) so as to achieve a three-dimensional structure with interconnected and locked panels, filler (8) being filled into the space between the front wall and the rear wall. As a result, a retaining wall structure is obtained which is internally locked in three dimensions and capable of withstanding both tensile and pressure stresses. Furthermore, the retaining wall structure can be built by unskilled construction workers.

11 Claims, 3 Drawing Sheets

RETAINING WALL STRUCTURE

TECHNICAL FIELD

The invention relates to a retaining wall structure for large-scale construction works, such as roads, railway tracks or quay constructions, where substantial amounts of earth or material are to be retained, wherein the wall structure comprises a front wall and a rear wall locked at a distance from said front wall by means of easily mountable crossbeams and wherein the crossbeams are locked relative to one another in vertical direction by means of locking beams so as to achieve a three-dimensional structure with interconnected and locked parts, filler being filled into the space between the front wall and the rear wall.

Background Art

U.S. Pat. No. 4,341,491 discloses an earth retaining structure including a frontal wall which is fixedly secured to a rear wall through tension rods passing therebetween. The frontal wall is constituted by a plurality of massive panels and the rear wall is constructed by wire mesh screens. The frontal panels are connected to vertical support members placed between said panels. This construction is, however, rather complicated and require skilled construction workers because stability problems may arise during its erection.

U.S. Pat. No. 4,490,075 discloses an interlocking block and retaining wall system derived from such blocks. The system comprises a frontal wall and a rear wall each of which consists of said blocks arranged atop of each other. All the blocks are:arranged so that they are in an upright position, i.e. no blocks are in an upside-down position. The walls are interconnected by crossbeams. This retaining wall system, however, does not involve use of panels.

Description of the Invention

The object of the invention is to provide a retaining wall structure of the above type, which is more simple and reliable than the previous structures, and which consequently can be built by unskilled construction workers.

The retaining wall structure according to the invention is characterised in that the front wall and the rear wall are constituted by substantially identical panels arranged side by side and above one another, the panels of each wall being arranged such that alternately they are in upright position and upside-down position and having hook-like members (19) interconnecting said panels, said members interlocking said panels in a horizontal direction. The resulting retaining wall structure is a so-called "gravity wall" and is particularly easy to build with the result that unskilled persons can perform the building thereof. During the building process, the individual parts of the retaining wall structure are quickly stabilized by the crossbeams and the locking beams. All the parts of the retaining wall structure are three-dimensionally locked with the effect that said parts can resist tensile and pressure forces in all three dimensions. No binder, such as mortar, is necessary. In addition, it is possible to build a relatively high and rather resilient retaining wall structure. The sand or earth being removed during the building of the retaining wall structure can be reused and consequently utilized as filler in the retaining wall structure. The panels of the front wall and the rear wall are suitably interconnected in such a manner that they cannot be displaced relative to one another. By arranging the panels such that alternately they are in upright position and upside-down position, and providing the panels with hook-like members interconnecting the panels, the members interlocking the panels in horizontal direction, the resulting connection of the panels of each wall is very reliable and prevents the panels from being mutually staggered in their own plane.

According to the invention, portions of the front wall and the rear wall may be mutually staggered in a direction perpendicular to their largest planar surface, whereby the retaining structure can be of a varying thickness.

Moreover according to the invention the panels of the front wall may directly oppose corresponding panels of the rear wall, whereby the panels and the crossbeams form "boxes". As a result, the filler of each "box" serves substantially as one large building unit instead of loose material.

Furthermore according to the invention, at least one partition may be provided between the front wall and the rear wall, said partition also being constituted by panels, whereby the stability of the retaining wall structure is additionally improved. When the filler, such as earth, sand etc., has been filled into the space(s) inside the retaining wall structure, said structure is particularly reliable and suited for preventing earth from sliding. The ground level of the retaining wall structure may for instance include four panels arranged behind one another whereas the "first" and "second" level of said structure include three panels arranged behind one another and the "third" and "fourth" level only include two panels arranged behind one another.

According to the invention, the panels may have recesses in the corners which co-operate with the crossbeams and with displacement-preventing locking members thereof, said displacement-preventing locking members serving to maintain a constant distance between panels arranged behind one another. As a result, the crossbeams are particularly easy to mount on the panels, the recesses guiding said crossbeams into their position.

Furthermore according to the invention, the front wall, the rear wall and the partitions, respectively, may be of a height many times exceeding the height of a panel. In this manner a high flexibility is obtained as to the amplification of the retaining wall structure.

According to the invention each locking beam may be substantially C-shaped in such a manner that it can grip and interlock two crossbeams arranged substantially above one another. Such locking beams proved to be very efficient.

Furthermore according to the invention, the locking members may be placed on a crossbeam where four abutting panels are to be connected, said locking members being formed by two pairs of substantially horizontal wing members arranged at a predetermined distance as well as by at least one substantially vertical wing member preventing the panels from being displaced perpendicular to the largest planar panel surface, where said wing members in addition are adapted to maintain a substantially constant angle between panels and crossbeams. In this manner the panels are prevented in a reliable manner from being displaced perpendicular to their largest planar surface. In addition, the wing members ensure that the angle formed by the panels with the crossbeams remain constant. According to the invention said constant angle is approximately 90°.

Moreover according to the invention, the panels may be cast and comprise weepholes with the result that possible moisture penetrating through the filler within the retaining wall structure can be drained off. Consequently, the risk of earth sliding from the interior of the retaining wall structure has been eliminated.

BRIEF DESCRIPTION OF THE DRAWING

The invention is described in greater detail below by way of examples with reference to the accompanying drawing, in which.

DESCRIPTION OF THE PREFERRED EMBODIMENTS OF THE INVENTION

Figure 1:
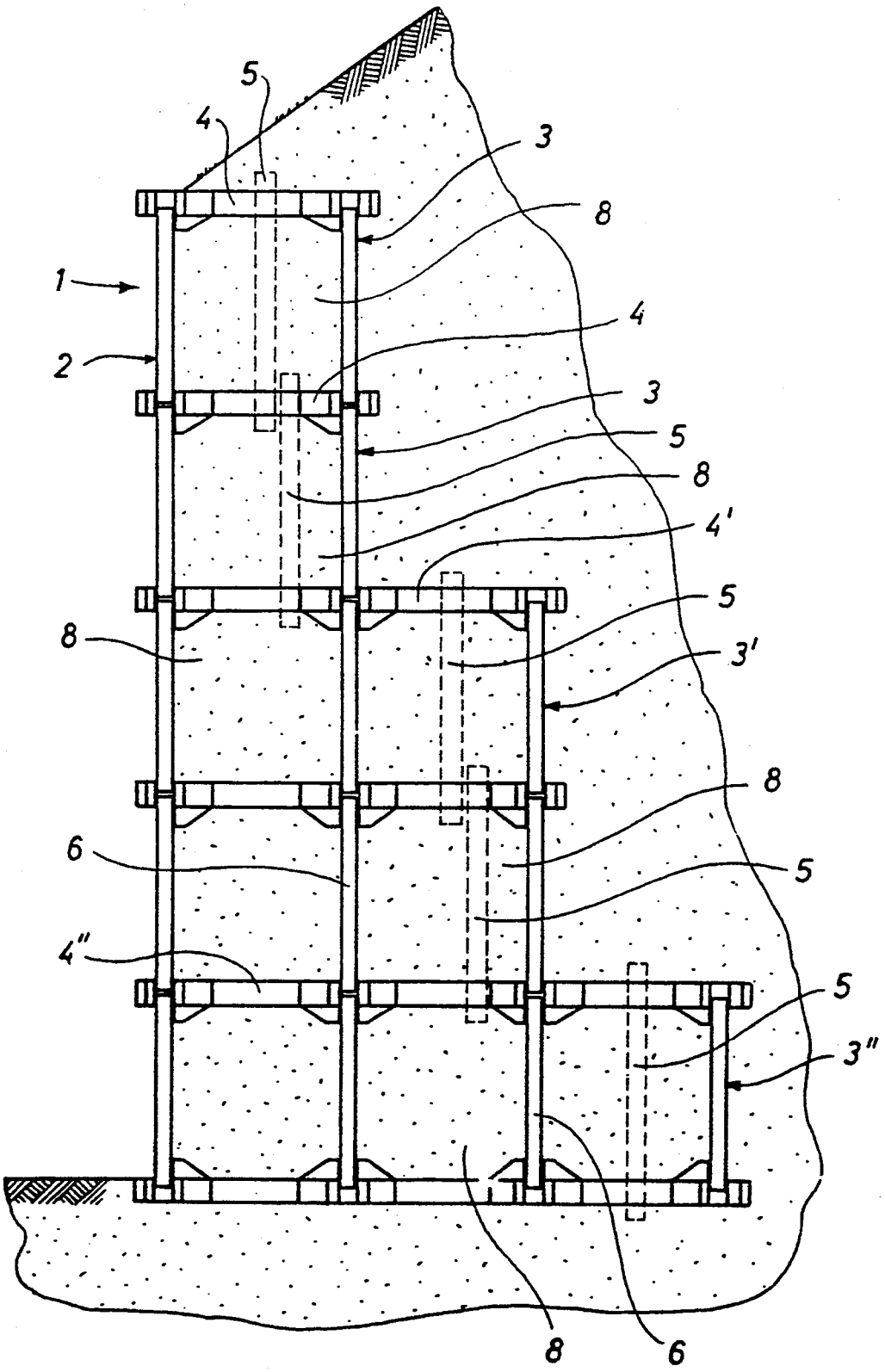
FIG. 1 is a side view of an embodiment of a retaining wall structure according to the invention, whereby an amount of the earth usually covering the end of the retaining wall structure has been removed.

The retaining wall structure 1 of FIG. 1 comprises a front wall 2 and a rear wall 3 spaced from one another by means of easily mountable crossbeams 4, 4', 4''. The crossbeams are interlocked in vertical direction by means of substantially vertically arranged locking beams 5. The locking beams are adapted to make the retaining wall structure stable, i.e. locked in three dimensions. A filler, such as earth, is filled into the space between the front wall and the rear wall. The retaining wall structure is particularly simply structured and can therefore be built by unskilled construction workers. In addition, the wall structure is easily adjustable to any ground.

The front wall and the rear wall are preferably constituted by cast, relatively large and substantially identical panels arranged side by side and in many cases also stacked atop one another. The front wall 2 includes thus panels in five levels. As illustrated, the rear wall includes portions displaced in the rear direction. The top portion of the rear wall includes panels in two levels, and the intermediary portion 3' includes also panels in two levels. The portion 3'' includes panels in only one level. Each panel appears at the reference numeral 9 of FIG. 2.

Figure 3:
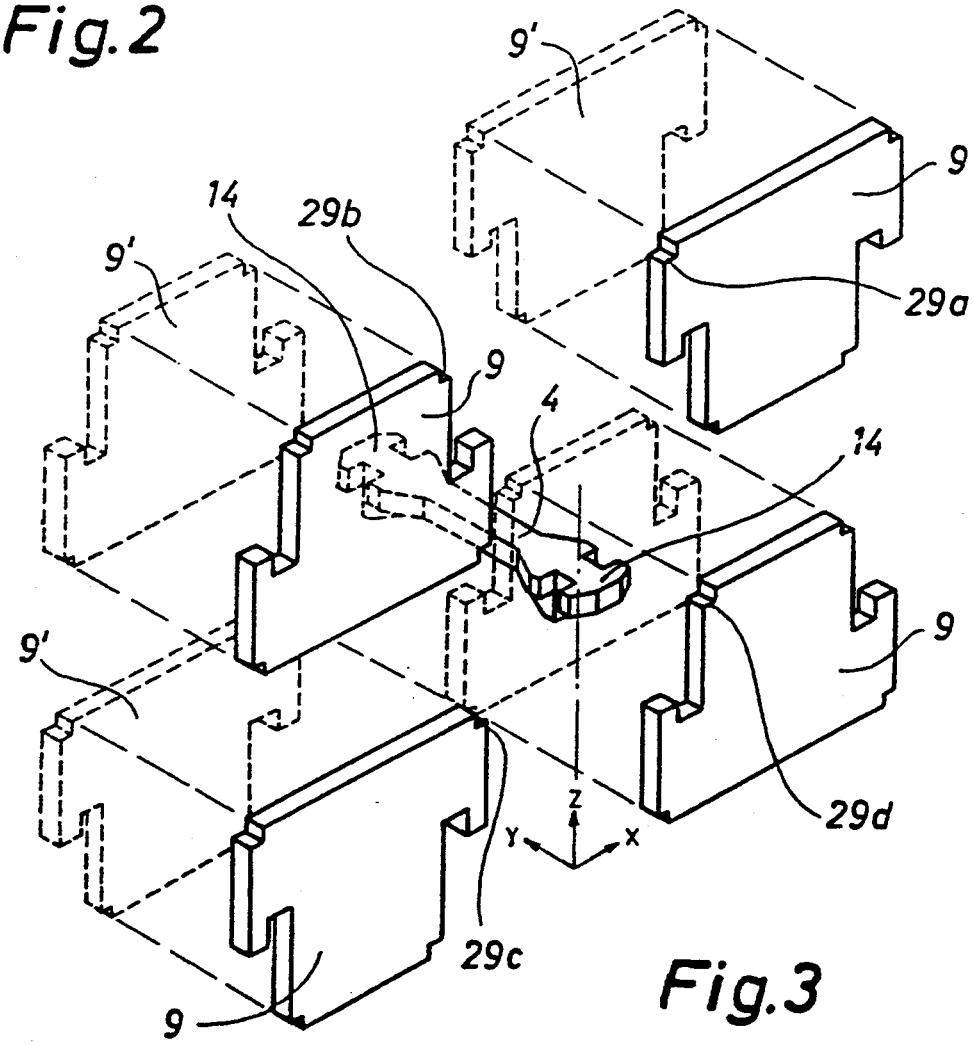
FIG. 3 illustrates a portion of a front wall where four panels have been separated from one another, and where the panels of the rear wall have been indicated by a dotted line and also separated from one another.

FIG. 3 shows how the panels 9 of the front wall 2 directly oppose corresponding panels 9' of the rear wall 3, and the panels are interconnected by means of crossbeams, cf. the crossbeam shown at 4. The panels 9 and 9' define a "box" which can be filled with earth, sand etc.

Figure 2:
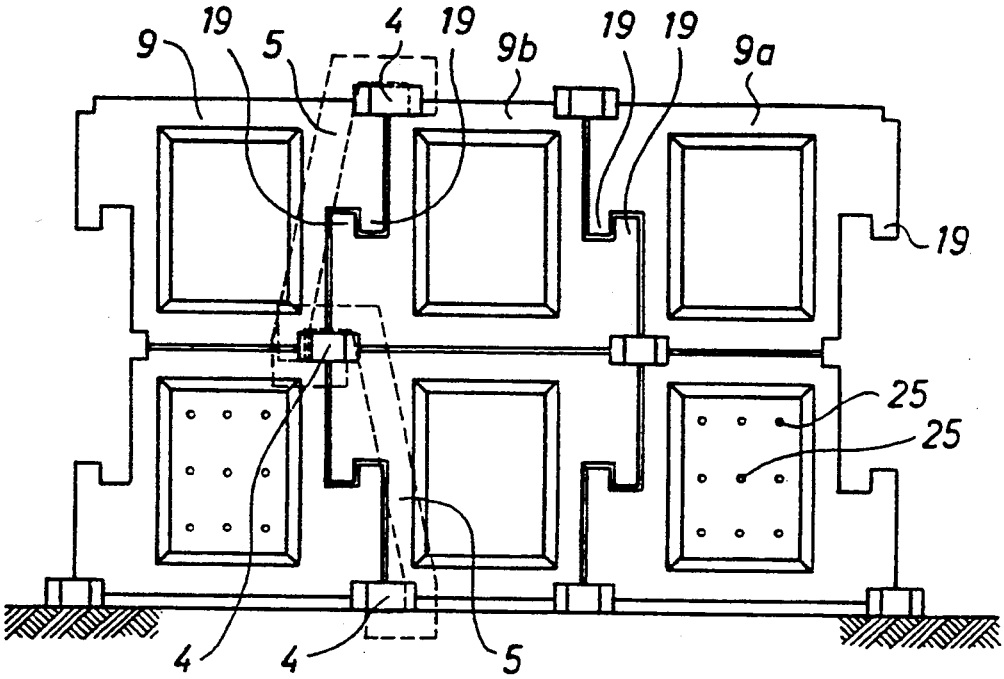
FIG. 2 is a front view of a portion of the retaining wall structure of FIG. 1, said view clearly showing the joining of the panels forming the front wall.

As illustrated in FIG. 2, the panels 9 of the front wall and of the rear wall are arranged such that alternately they are in upright position or in upside-down position. Thus the panel **9*a* is in upright position whereas the panel 9*b* is in the upside-down position. The panel 9*a* is provided with hook-like members 19 for joining the panel 9*a* with the hook-like members 19** of neighboring panels to the left and right.

At least one partition 6 can be provided between the front wall 2 and the rear wall 3. The partition is also constituted by panels, preferably corresponding to the panels of the front wall and of the rear wall. The provision of many partitions between the front wall and the rear wall makes the retaining wall structure correspondingly thicker.

FIG. 3 shows how each panel 9 comprises recesses **10*a*, 10*b*, 10*c*, 10*d* in the corners, said recesses co-operating with the crossbeams 4 and with the displacement-preventing locking members 14 thereof. The locking members ensure a constant distance between the panels 9 and 9' arranged behind one another. As indicated in FIG. 1, the retaining wall structure comprising the front wall, the rear wall and the partitions may be of a height many times exceeding the height of a panel 9**.

Figures 10, 11:
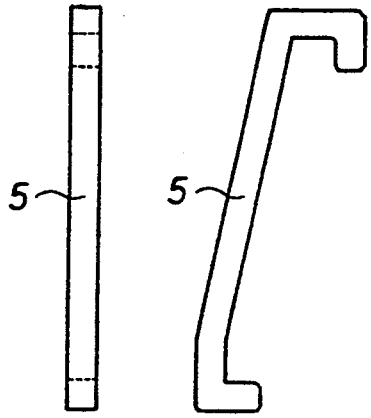
FIG. 10 is a front view of a locking beam.
FIG. 11 is a side view of the locking beam of FIG. 10.

FIG. 10 shows how each locking beam 7 can be substantially C-shaped with the result that it can grip and retain two opposing crossbeams 4. FIG. 2 illustrates in a particularly clear manner how two crossbeams 7 can be arranged.

FIG. 11 is a side view of the locking beam. Note that all parts of the locking beam are in the same plane.

Figure 4:
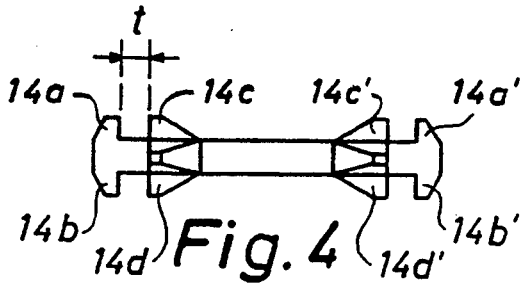
FIG. 4 is a bottom view of a crossbeam for two panels.

FIG. 4 shows an embodiment of a crossbeam 4 for only one front wall and one rear wall. FIG. 4 shows how the locking members which are to be connected to four abutting panels, cf. FIG. 3, can be formed by two pairs of substantially horizontal wing members **14*a*, 14*b* and 14*c*, 14*d* interspaced a predetermined distance t. The crossbeam 4 is further provided with a substantially vertical wing member 24, 24'** preventing a displacement of the panels perpendicular to their largest planar surface. The distance t be-tween the pairs of wing members corresponds substantially to the thickness of each panel. The wing members ensure furthermore that the angle formed by the panels with the crossbeams can remain 90°.

Figure 6:
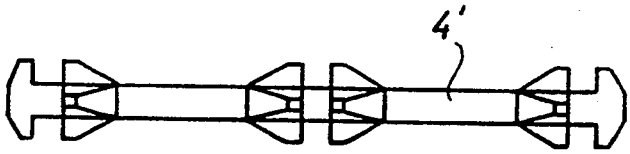
FIG. 6 is a bottom view of a crossbeam for three panels.
Figure 7:
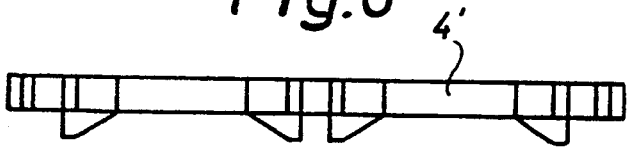
FIG. 7 is a side view of the crossbeam of FIG. 6.

FIGS. 6 and 7 show an embodiment of the crossbeam 4'0 where said crossbeam is to co-operate with three panels arranged behind one another, the intermediary panel forming the partition.

Figure 5:
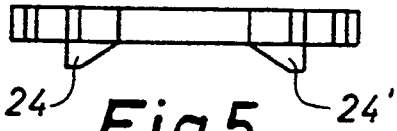
FIG. 5 is a side view of the crossbeam of FIG. 4.
Figure 8:
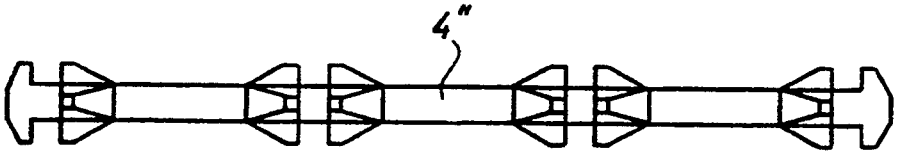
FIG. 8 is a bottom view of a crossbeam for four panels
Figure 9:
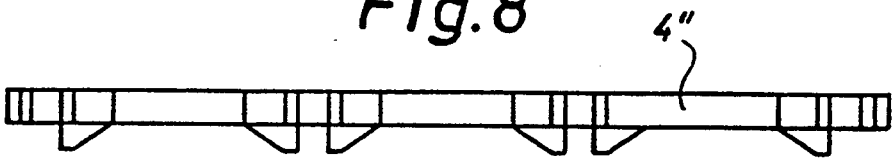
FIG. 9 is a side view of the crossbeam of FIG. 8.

FIGS. 8 and 9 show an embodiment of a crossbeam 4'' for use when the retaining wall structure includes two partitions. Here the retaining wall structure presents a thickness corresponding to the thickness of one or more building units. In FIGS. 4 and 5 the thickness of the wall structure corresponds to the thickness of one building unit, in FIGS. 6 and 7 to the thickness of two building units, and in FIGS. 8 and 9 to the thickness of three building units.

Each panel can comprise weepholes 25, cf. FIG. 2, said weepholes ensuring a suitably fast draining off of water from the filler, i.e. earth, sand or the like material, inside the retaining wall structure.

The panels, the crossbeams and the locking beams are preferably made of cast concrete, and optionally reinforced.

The retaining wall structure according to the invention is primarily used for large-scale construction works, such as roads, railway tracks or quay constructions, where considerable amounts of earth or material are to be retained.

It should be noted, that the panels can be interlocked at different angles to each other to form curves so as to follow the road bends.

The interlocking of the panels also allows a slight curving up and down so as to allow for possible settlements of the wall.

The crossbeams can bring stress or compression forces from front to rear panels.

In addition it should be noted that the locking beams form a particular interlocking of the crossbeams in such a manner that said crossbeams are not essentially forced out of their position due to tensile and pressure stresses from the outside. The locking beams can withstand vertical stress forces. Accordingly, an efficient three-dimensional locking is provided.

The invention may be varied in many ways without thereby deviating from the scope thereof.

I claim:

1. A retaining wall structure for large-scale construction works, such as roads, railway tracks or quay constructions, where substantial amounts of earth or material are to be retained, wherein the wall structure comprises a front wall and a rear wall locked at a distance from said front wall by means of easily mountable crossbeams, and wherein the crossbeams are locked relative to one another in vertical direction by means of locking beams so as to achieve a three-dimensional structure with interconnected and locked parts, filler being filled into the space between the front wall and the rear wall, characterised in that the front wall and the rear wall are constituted by substantially identical panels arranged side by side and above one another, the panels of each wall being arranged such that alternately they are in upright position and upside-down position and having hook-like members interconnecting said panels, said members interlocking said panels in a horizontal direction.

2. A retaining wall structure as claimed in claim 1, characterised in that portions of the front wall and of the rear wall are mutually staggered in a direction perpendicular to their largest planar surface, whereby the retaining structure can be of a varying thickness.

3. A retaining wall structure as claimed in claim 1, characterised in that the panels of the front wall directly oppose corresponding panels of the rear wall.

4. A retaining wall structure as claimed in claim 1, characterised in that at least one partition is provided between the front wall and the rear wall, said partition also being constituted by panels.

5. A retaining wall structure as claimed in claim 1, characterised in that the panels have recesses in their corners which co-operate with the crossbeams and with displacement-preventing locking members thereof, said displacement-preventing locking members serving to maintain a constant distance between the panels arranged behind one another.

6. A retaining wall structure as claimed in claim 1, characterised in that the front wall, the rear wall and the partitions, respectively, are of a height many times exceeding the height of a panel.

7. A retaining wall structure as claimed in claim 1, characterised in that each locking beam is substantially C-shaped in such a manner that it can grip and interlock two crossbeams arranged substantially above one another.

8. A retaining wall structure as claimed in claim 1, characterised in that the locking members are placed on a crossbeam where four abutting panels are to be connected, said locking members being formed by two pairs of substantially horizontal wing members arranged at a predetermined distance as well as by at least one substantially vertical wing member preventing panels from being displaced perpendicular to the largest planar panel surface, where said wing members in addition are adapted to maintain a substantially constant angle between panels and crossbeams.

9. A retaining wall structure as claimed in claim 8, characterised in that said constant angle is approximately 90°.

10. A retaining wall structure as claimed in claim 1, characterised in that the panels are cast and provided with weepholes.

11. A retaining wall structure as claimed in any of the preceding claims for roads, railway tracks or quay constructions, characterised in that filler in form of earth or sand is filled into the space between the front wall and the rear wall.

* * * * *